US007347685B2

(12) United States Patent
Baranowski, Jr.

(10) Patent No.: US 7,347,685 B2
(45) Date of Patent: Mar. 25, 2008

(54) TORCH MANIFOLD WITH INTEGRATED NOZZLES

(75) Inventor: Frank Baranowski, Jr., Lynnfield, MA (US)

(73) Assignee: General Regulator, Inc., Lynnfield, MA (US)

( * ) Notice: Subject to any disclaimer, the term of this patent is extended or adjusted under 35 U.S.C. 154(b) by 0 days.

(21) Appl. No.: 10/884,778

(22) Filed: Jul. 2, 2004

(65) Prior Publication Data

US 2006/0003278 A1 Jan. 5, 2006

(51) Int. Cl.
*F23D 14/02* (2006.01)
*F23D 14/04* (2006.01)
*F23D 14/62* (2006.01)
*F23D 14/52* (2006.01)

(52) U.S. Cl. ..... 431/344; 431/278; 431/354

(58) Field of Classification Search ..... 431/278–285, 431/354, 355, 255, 344; 126/40, 39 R, 39 E, 126/39 N; 239/424, 278–285, 548–550
See application file for complete search history.

(56) References Cited

U.S. PATENT DOCUMENTS 123,536 A * 2/1872 Wilkinson ..... 239/424
164,213 A * 6/1875 Reed ..... 239/565
437,268 A * 9/1890 Wallwork ..... 431/245
567,659 A * 9/1896 Ruppel ..... 431/225
623,237 A * 4/1899 Crossland ..... 126/39 R
672,684 A * 4/1901 Rosier ..... 431/247
856,582 A * 6/1907 Harper ..... 239/416.5
862,173 A * 8/1907 Kent ..... 431/247
1,046,112 A * 12/1912 Schweitzer ..... 239/424
1,047,200 A * 12/1912 Gehring ..... 431/355
1,227,189 A * 5/1917 Ostrander ..... 239/424
1,353,214 A * 9/1920 Calmer ..... 239/565
1,481,189 A * 1/1924 Daniels ..... 239/565
1,497,954 A * 6/1924 Shaw et al. ..... 137/583
1,515,067 A * 11/1924 Olsen, Jr. ..... 126/39 J
1,517,394 A * 12/1924 Bengtson ..... 431/354
1,641,275 A * 9/1927 Hughes ..... 239/431
1,818,222 A * 8/1931 Hughes ..... 239/433
1,838,506 A * 12/1931 Tinnerman ..... 126/39 N
1,878,552 A * 9/1932 Tinnerman ..... 431/192
1,922,348 A * 8/1933 Beck ..... 239/419.5

(Continued)

FOREIGN PATENT DOCUMENTS

EP 0694732 * 1/1996

(Continued)

OTHER PUBLICATIONS

General Regulator, Inc., *Crosstech 357™ Self Igniting Professional Torches with Electronic Ignition*. Product Brochure B1003 (2000, Rev. A, Mar. 20, 2000).

(Continued)

*Primary Examiner*—Carl D. Price
(74) *Attorney, Agent, or Firm*—Iandiorio, Teska & Coleman

(57) ABSTRACT

A manifold for a torch including a gas distribution portion for distributing gas directed into the manifold to two or more gas channels, a nozzle in each gas channel, an air passage in the manifold proximate each nozzle, and a flame tube portion including a channel for mounting each flame tube adjacent a nozzle.

2 Claims, 7 Drawing Sheets

U.S. PATENT DOCUMENTS

| | | | | | |
|---|---|---|---|---|---|
| 1,962,251 | A | * | 6/1934 | Magin | 126/39 N |
| 2,109,497 | A | * | 3/1938 | Marvin et al. | 431/193 |
| 2,134,972 | A | * | 11/1938 | Haney | 431/347 |
| 2,369,235 | A | * | 2/1945 | Jaros | 431/181 |
| 2,577,451 | A | * | 12/1951 | Gunter et al. | 169/15 |
| 3,707,067 | A | * | 12/1972 | Dietrick | 96/241 |
| 3,768,962 | A | * | 10/1973 | Baranowski, Jr. | 431/353 |
| 3,917,443 | A | * | 11/1975 | Adams | 431/354 |
| 4,020,821 | A | * | 5/1977 | Reid et al. | 126/39 E |
| D263,790 | S | | 4/1982 | Baranowski, Jr. | |
| D372,654 | S | * | 8/1996 | Baranowski, Jr. | D8/30 |
| D374,384 | S | * | 10/1996 | Baranowski, Jr. | D8/30 |
| 6,027,332 | A | * | 2/2000 | Glotin et al. | 431/202 |
| 6,076,517 | A | * | 6/2000 | Kahlke et al. | 126/39 J |
| 6,132,205 | A | * | 10/2000 | Harneit | 431/354 |
| 6,276,615 | B1 | * | 8/2001 | Scholz | 239/424 |
| 6,332,460 | B1 | * | 12/2001 | Paesani | 126/39 R |
| 2004/0072113 | A1 | * | 4/2004 | Chuan | 431/344 |

FOREIGN PATENT DOCUMENTS

| | | | |
|---|---|---|---|
| FR | 2708716 | * | 2/1995 |
| JP | 10-89635 | * | 10/1998 |

OTHER PUBLICATIONS

General Regulator, Inc., *Crosstech® Professional Torches*. Product Brochure B1002 (2001, Rev. D, Jun. 11, 2001).

General Regulator, Inc., *Crosstech Professional Torches™*. Product Brochure B1001 (1990, Rev. 0, Apr. 4, 1990).

General Regulator, Inc., *Crosstech Professional Torches™ with New Solder Clean Out Feature*. Product Brochure *Cleanout* (1999, Rev. 1, Oct. 9, 1999, p. 65).

Thermadyne, *TurboTorch®*., Product Brochure, Propane and MAPP®, p. 12-14, no date.

Uniweld Products, Inc., *Unitorch® Hand Torch RP3T2*, (visited May 11, 2004) <http://www.uniweld.com/catalog/air_gas/unitorch/rp3t2.htm>.

Uniweld Products, Inc., *Unitorch® Hand Torch RP3T3*, (visited May 11, 2004) <http://www.uniweld.com/catalog/air_gas/unitorch/rp3t3.htm>.

* cited by examiner

TORCH MANIFOLD WITH INTEGRATED NOZZLES

FIELD OF THE INVENTION

This invention relates to a torch assembly and a novel torch manifold with integrated nozzles.

BACKGROUND OF THE INVENTION

Prior art dual or triple flame tube torches designed and sold by the applicant hereof are often used by plumbers for soldering operations. A typical torch assembly includes a manifold connected to a regulator. The manifold distributes gas from the source tank regulated by the regulator to two or three flame tubes. Each flame tube, in turn, includes a nozzle below a venturi and situated in an air passage through the flame tube. U.S. Design Pat. No. 263,790, incorporated herein by this reference, discloses one such dual flame tube torch design.

These prior art designs have enjoyed considerable commercial success but there is room for improvement in the nature of cost reduction.

SUMMARY OF THE INVENTION

It is therefore an object of this invention to provide a torch assembly which is less costly.

It is a further object of this invention to provide a torch assembly which has less component parts.

It is a further object of this invention to provide a torch assembly which is easier and faster to assemble.

It is a further object of this invention to provide a torch which performs as well as prior art torches.

The subject invention results from the realization that if the nozzles of a torch assembly are located in the manifold instead of in the torch tubes, a significant part reduction is achieved leading to a torch assembly which is less costly and easier to manufacture.

The subject invention, however, in other embodiments, need not achieve all these objectives and the claims hereof should not be limited to structures or methods capable of achieving these objectives.

This invention features a manifold for a torch, the manifold comprising a gas distribution portion for distributing gas directed into the manifold to two or more gas channels, a nozzle in each gas channel, an air passage in the manifold proximate each nozzle, and a flame tube portion including a channel for mounting each flame tube adjacent a nozzle.

Typically, there is a venturi in each flame tube. The gas distribution portion usually includes a main channel in communication with two or three gas channels. In the preferred embodiment, the gas distribution portion is separated from the flame tube portion by a post defining a circumferential air passage. In another example, the air passage is through the manifold between the gas distribution portion and the flame tube portion across the nozzles. Another air passage may be through the manifold between the gas distribution portion and the flame tube portion between the nozzles. In another example, air passages through the manifold intercept each nozzle.

A complete torch assembly in accordance with this invention features a regulator, a manifold connected to the regulator and including integrated nozzles, and two, three, or more flame tubes connected to the manifold. In the preferred embodiment, the manifold includes a gas distribution portion for distributing gas to two or more gas channels. The gas distribution portion may include a main channel in communication with each gas channel and a nozzle is positioned in each gas channel. Also in the preferred embodiment, the manifold includes a flame tube portion. In one example, the flame tube portion is separated from the gas distribution portion by a post defining a circumferential air passage extending radially outward from the post. The flame tube portion typically includes a channel for mounting each flame tube adjacent a nozzle.

In another example, one air passage is through the manifold between the gas distribution portion and the flame tube portion across the nozzles and another air passage is through the manifold between the gas distribution portion and the flame tube portion between the nozzles. In still another example, separate air passages through the manifold intercept each nozzle.

A manifold for a torch in accordance with this invention typically includes two or more gas channels in communication with a main channel, a nozzle in each gas channel, at least one air passage for delivering air to the nozzles, and two or more flame tube channels each adjacent a nozzle. In the preferred embodiment, the manifold includes a gas distribution portion including the gas channels and the main channel and also a flame tube portion including the flame tube channels.

BRIEF DESCRIPTION OF THE DRAWINGS

Other objects, features and advantages will occur to those skilled in the art from the following description of a preferred embodiment and the accompanying drawings, in which.

DISCLOSURE OF THE PREFERRED EMBODIMENT

Figure 1:
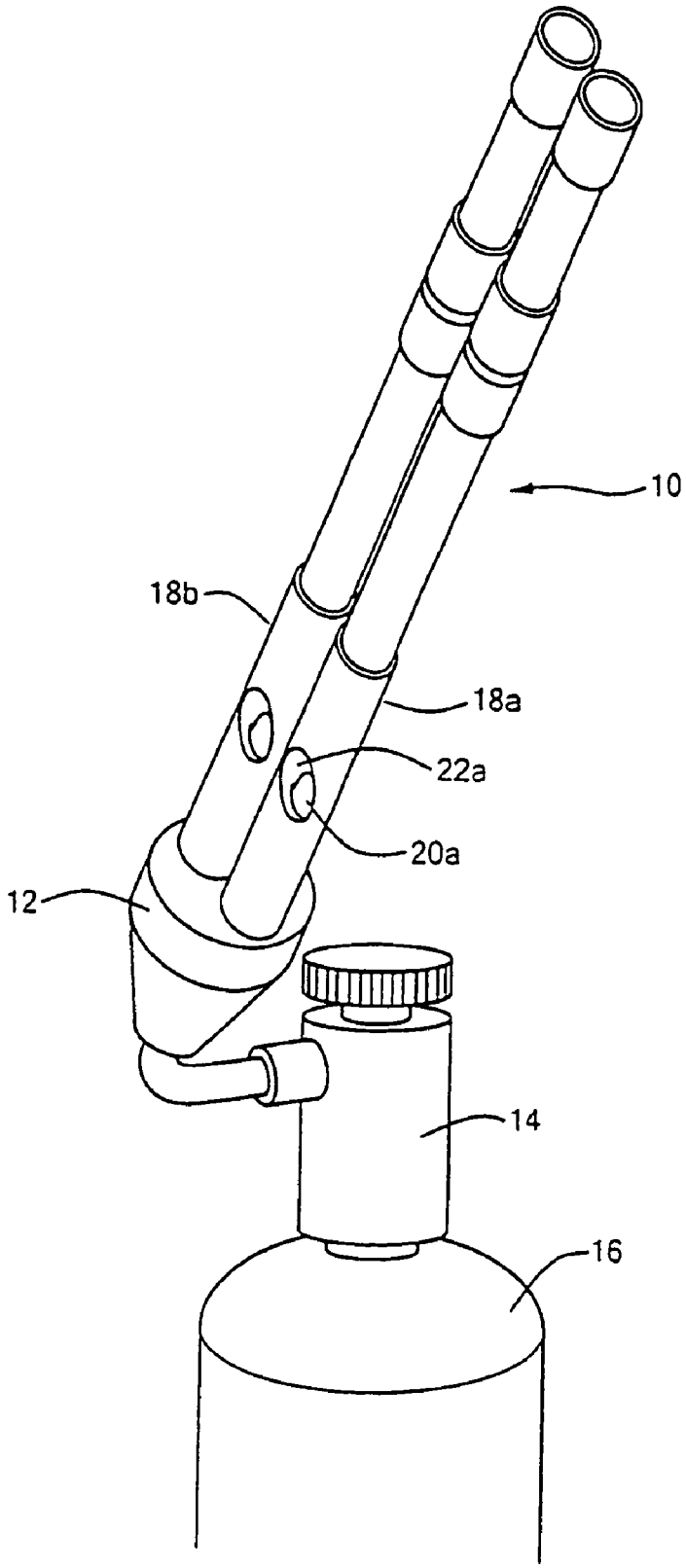
FIG. 1 PRIOR ART
FIG. 1 is a schematic three-dimensional view of a typical dual flame tube torch assembly in accordance with the prior art.

Aside from the preferred embodiment or embodiments disclosed below, this invention is capable of other embodiments and of being practiced or being carried out in various ways. Thus, it is to be understood that the invention is not limited in its application to the details of construction and the arrangements of components set forth in the following description or illustrated in the drawings. If only one embodiment is described herein, the claims hereof are not to be limited to that embodiment. Moreover, the claims hereof are not to be read restrictively unless there is clear and convincing evidence manifesting a certain exclusion, restriction, or disclaimer.

FIG. 1 shows prior art torch assembly 10 with manifold 12 connected to regulator 14. Manifold 12 distributes gas from tank 16 as regulated by regulator 14 to flame tubes 18*a* and 18*b*. A nozzle such as nozzle 20*a* is located in each flame tube. An air passage 22*a* through torch base 18*a* surrounds nozzle 20*a*. A torch assembly accommodating three flame tubes is also available from the applicant hereof.

Figure 2:
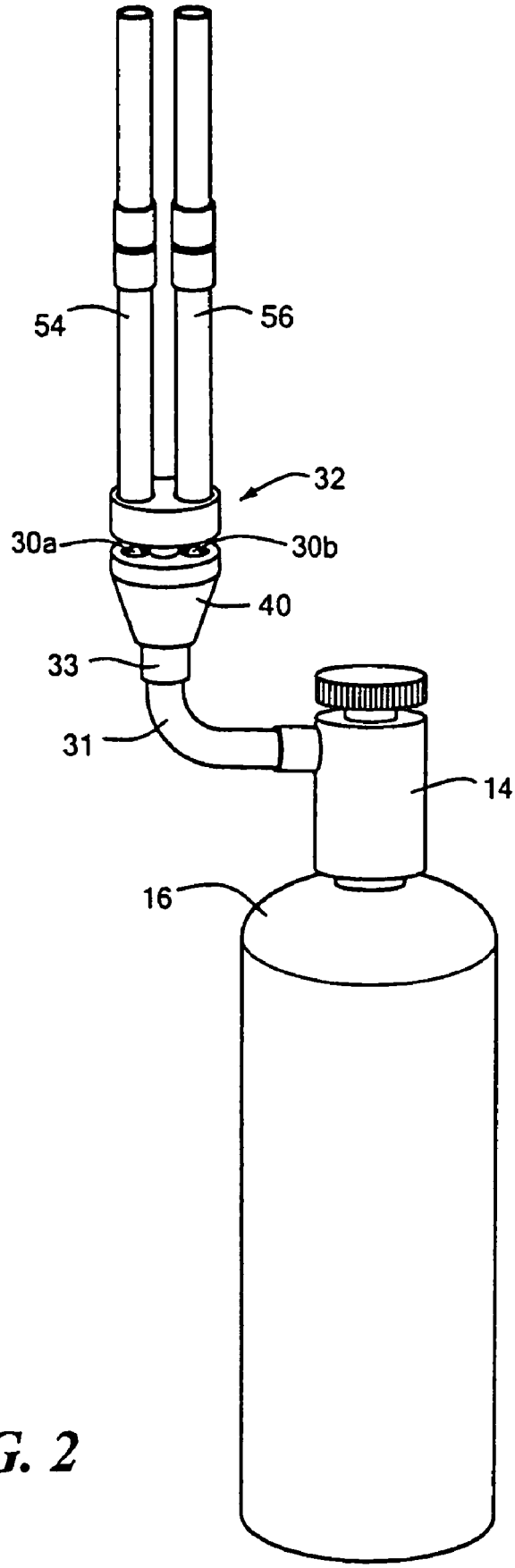
FIG. 2 is a schematic three-dimensional view of a dual flame tube torch assembly in accordance with the subject invention.

In the subject invention, fourteen component parts were eliminated from the design shown in FIG. 1 by integrating nozzles 30*a* and 30*b*, FIG. 2 in specially designed manifold 32 connected to regulator 14.

Figure 3:
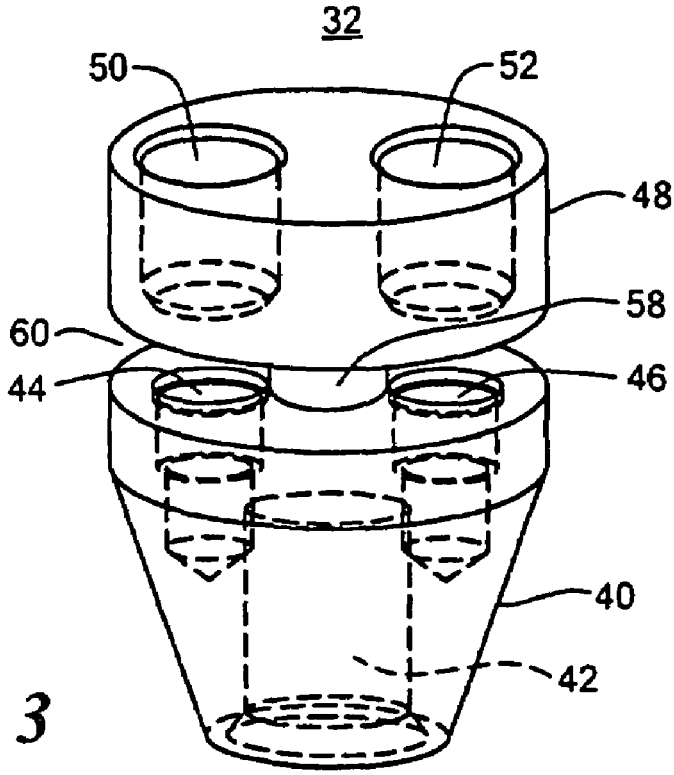
FIG. 3 is a schematic view of the manifold of the torch assembly shown in FIG. 2.
Figure 4:
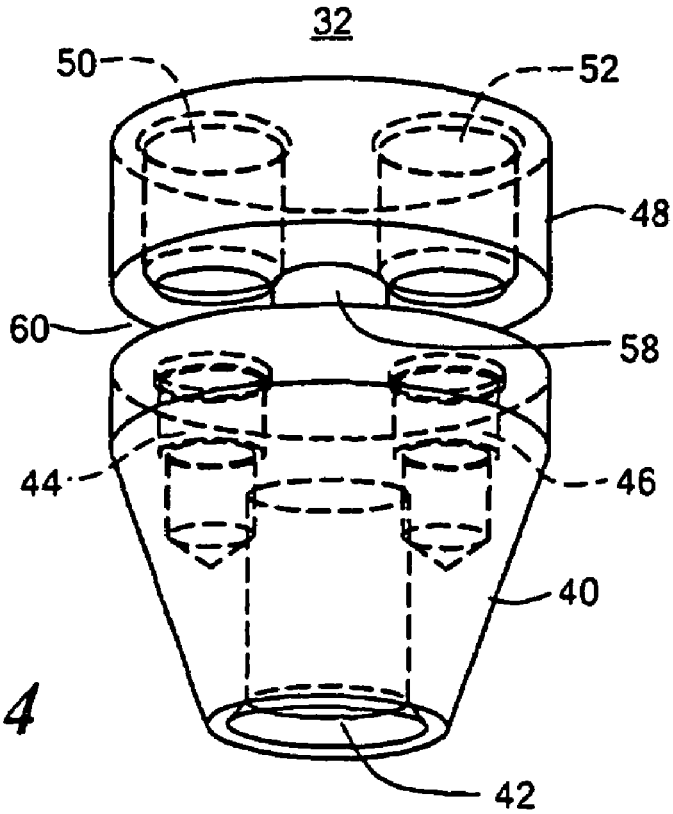
FIG. 4 is another schematic view of the manifold for the torch assembly shown in FIG. 2.
Figure 5:
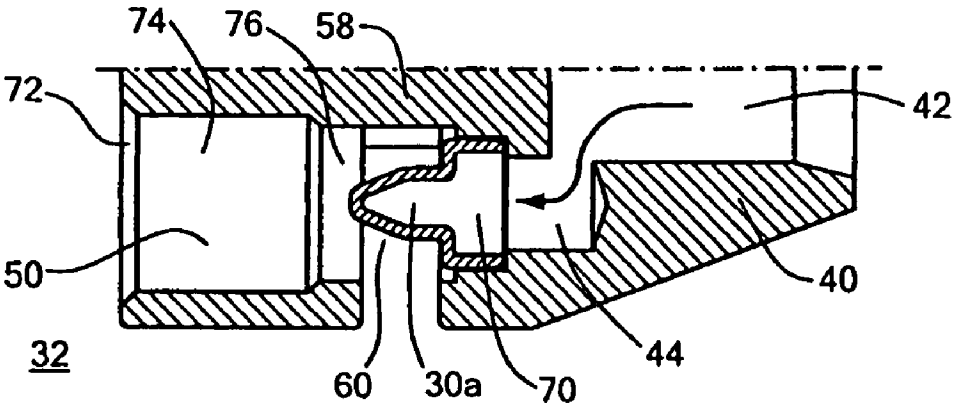
FIG. 5 is a more detailed schematic cross-sectional view of one half of the manifold shown in FIGS. 3 and 4.

In this preferred example, manifold 32, FIGS. 3-4 includes gas distribution portion 40 for distributing gas directed into the manifold at main channel 42 to gas channels 44 and 46. A nozzle (see FIG. 2) is located in each gas channel 44 and 46. Manifold 32, FIGS. 3-4 also includes flame tube portion 48 including channels 50 and 52 for mounting flame tubes 54 and 56, FIG. 2 adjacent nozzles 30*a* and 30*b*, respectively. Since manifold 32 instead of flame tubes 54 and 56 include nozzles 30*a* and 30*b*, numerous components were eliminated from the design shown in FIG. 1 rendering the torch assembly shown in FIG. 2 less costly to manufacture and easier and faster to assemble. In this particular embodiment, gas distribution portion 40, FIGS. 3-4, is separated from flame tube portion 48 by post 58 defining circumferential air passage 60 proximate nozzles 30*a* and 30*b*, FIG. 2 extending radially outward from post 58. FIG. 5 shows a more detailed configuration for manifold 32. Main channel 42 in distribution portion 40 is drilled in aluminum stock to overlap gas channel 44 in which nozzle 30*a* is received. Air passage 60 is machined to define post 58 and flame tube channel 50 is drilled as shown. Gas distribution portion 40, FIG. 2 of manifold 32 is connected to swivel 31 of regulator 14 by adapter 33 discussed below with reference to FIG. 11.

In one specific example, air passage 60 is 0.2" wide. Post 58 is 0.500" in diameter. Main gas flow channel 42 is centered in gas distribution portion 40 and is 0.502" in diameter. Gas channel 44 overlaps main gas flow channel 42 by 0.031" as shown and is 0.281" in diameter at the overlap location and 0.330" in diameter at portion 70 to accommodate nozzle 30*a*. Flame tube channel 50 is 0.468" in diameter at opening 72, 0.436" in diameter at main portion 74, and 0.375" in diameter at distal portion 76.

Figure 6:
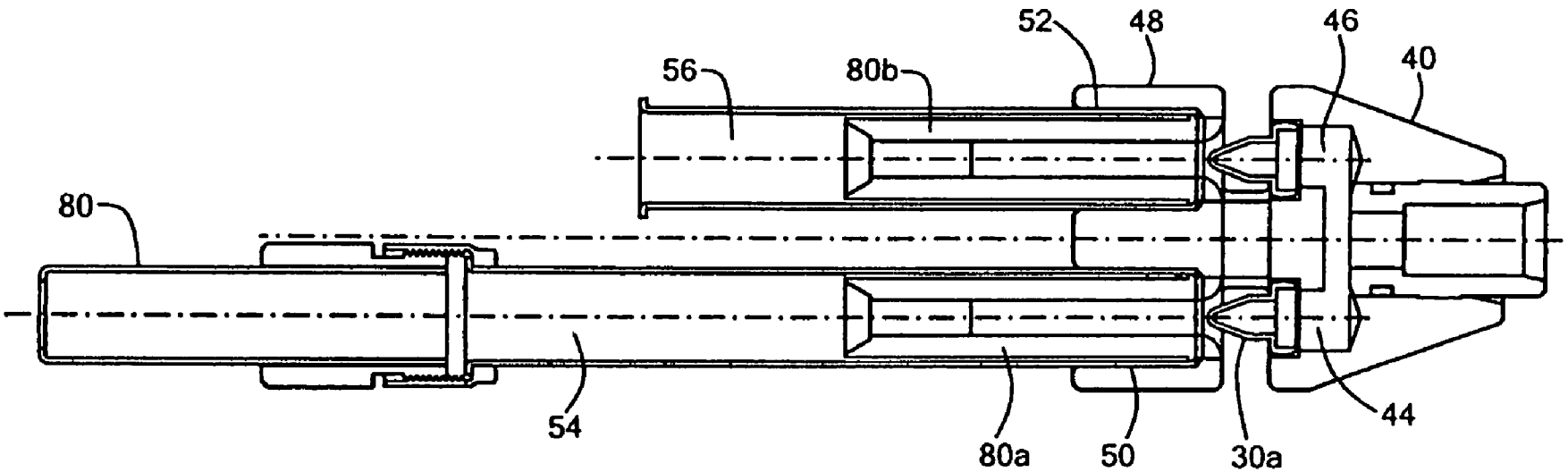
FIG. 6 is a schematic sectional view of the manifold assembly shown in FIG. 5 with the addition of the flame tubes.
Figure 7:
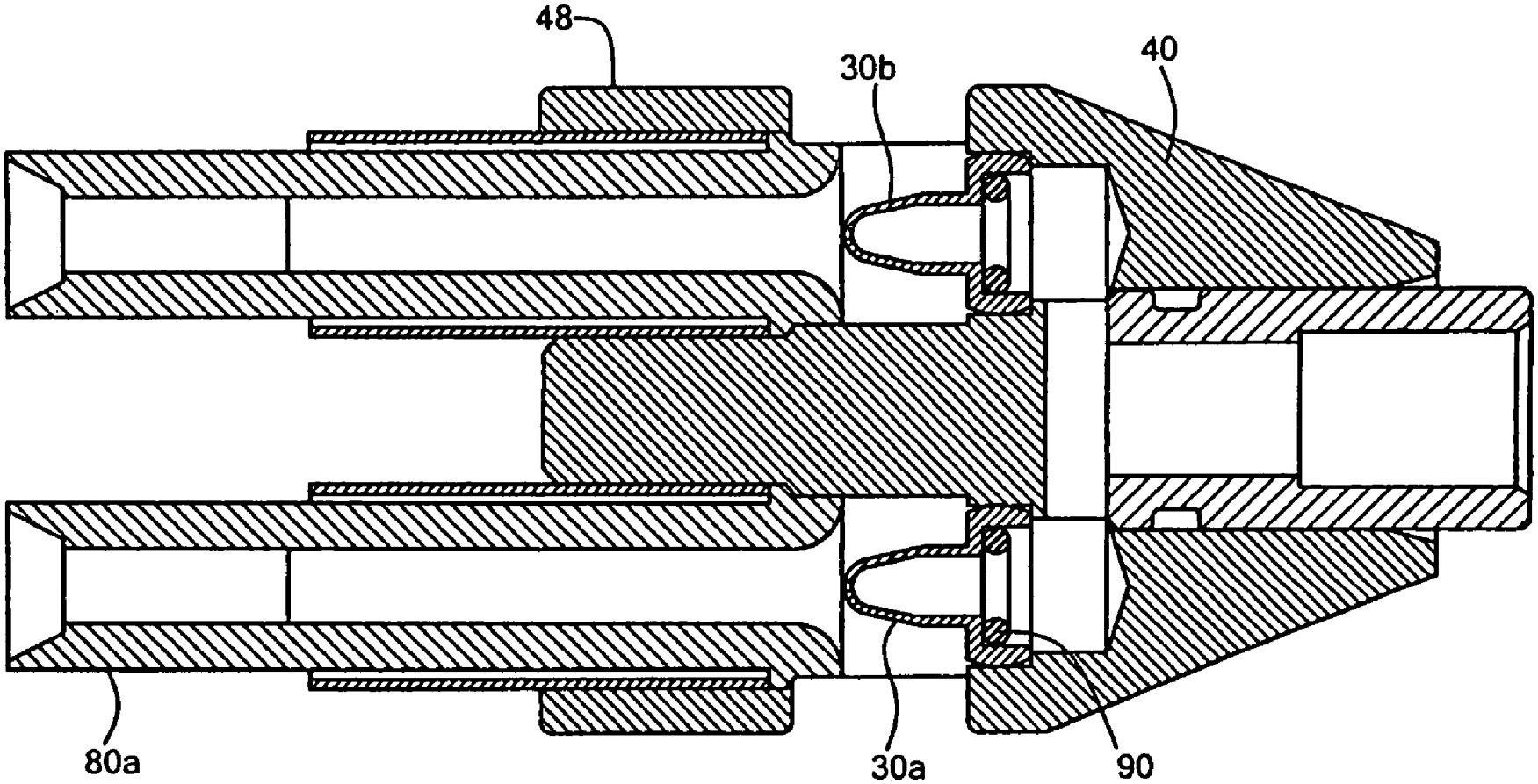
FIG. 7 is another schematic cross-sectional view similar to FIG. 6.

FIGS. 6-7 show the installation of flame tubes 54 and 56 in flame tube channels 50 and 52, respectively, and a venturi 80*a* and 80*b* in each flame tube. The flame tubes also preferably include removable tips such as removable tip 80 shown for flame tube 54. O-ring 90, FIG. 7 holds a filter screen in place below nozzle 30*a*.

Figure 8:
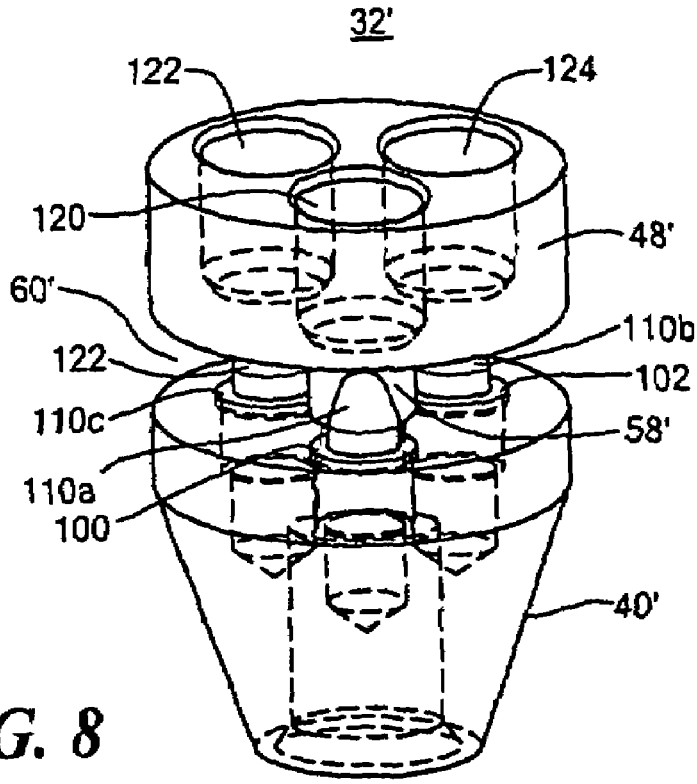
FIG. 8 is a schematic three-dimensional view of a triple flame tube manifold in accordance with the subject invention.

FIG. 8 shows a triple flame tube torch version of manifold 32' including gas distribution portion 40' with three gas channels 100, 102, and 104 each including a nozzle 110*a*, 110*b*, and 110*c*, respectively. Flame tube portion 48' includes three corresponding flame tube channels 120, 122, and 124. Post 58' separates flame tube portion 48' from gas distribution portion 40' defining circumferential air passage 60' about nozzles 110*a*, 110*b*, and 110*c* similar to the design discussed above with reference to FIGS. 2-7.

Figure 9:
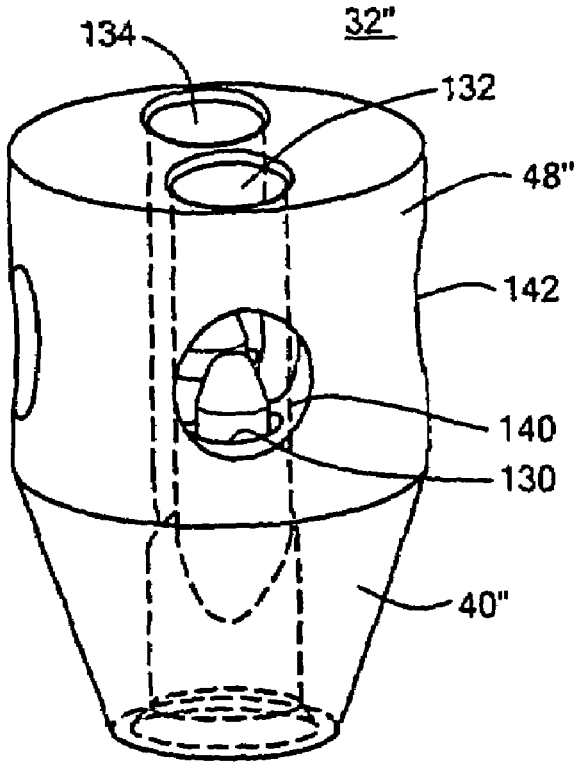
FIG. 9 is a schematic three-dimensional view showing another dual flame tube manifold in accordance with the subject invention.

The subject invention is not limited to a circumferential air passage as shown in FIGS. 2-8, however. In the embodiment shown in FIG. 9, manifold 32" includes gas distribution portion 40" which distributes gas to gas channel 130 and another gas channel, not shown, on the opposite side of gas channel 130. Flame tube portion 48" includes flame tube channels 132 and 134. Air passage 140 is through manifold 32" between gas distribution portion 40" and flame tube portion 48" across and intersecting both flame tube channels 132 and 134 and both gas channels 130 and the other gas channel (not shown). Additional air passage 142 between the nozzles is also through manifold 32" and intercepts air passage 140 at the center of the manifold.

Figure 10:
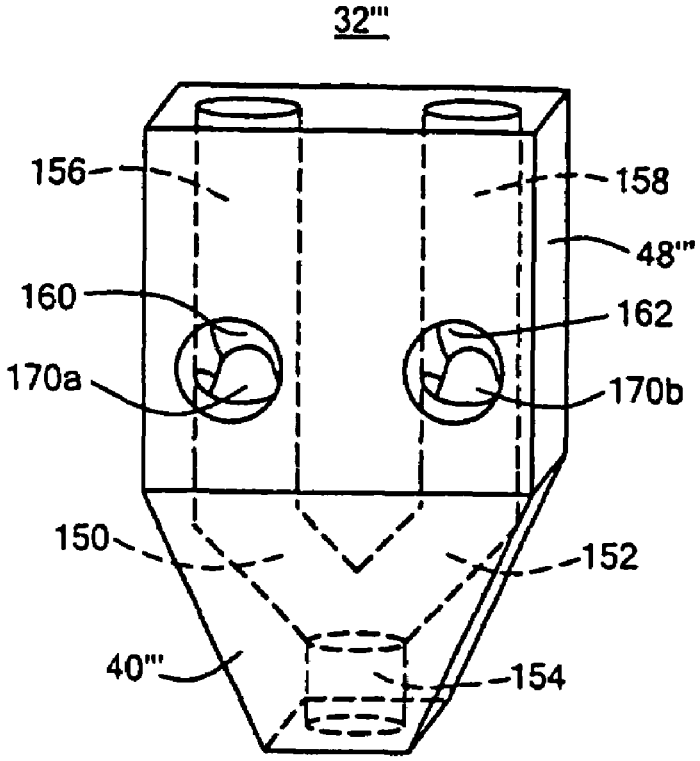
FIG. 10 is a schematic three-dimensional view showing still another dual flame tube manifold assembly in accordance with the subject invention.

In the embodiment shown in FIG. 10, flat faced manifold 32''' includes gas distribution portion 40''' with gas channels 150 and 152 in communication with main channel 154 and flame tube portion 48''' including flame tube channels 156 and 158. Separate air passages 160 and 162 are both through manifold 32''' between gas distribution portion 40''' and flame tube portion 48''' intercepting nozzles 170*a* and 170*b*, respectively. Air passage 160 also intercepts gas channel 150 and flame tube channel 156. Air passage 162, in turn, intercepts gas channel 152 and flame tube channel 158.

Figure 11:
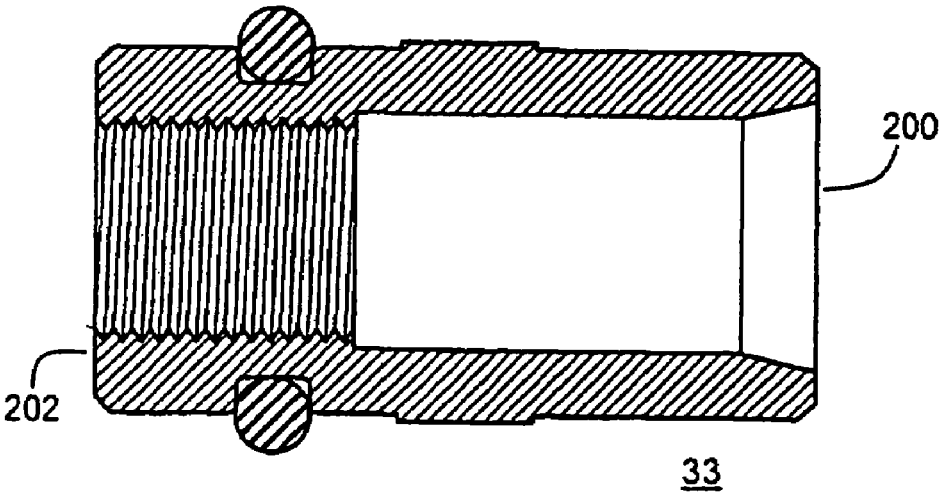
FIG. 11 is a schematic view of the adaptor shown in FIG. 2 used to connect the manifold to the regulator.

Adaptor 33, FIG. 11 as shown in FIG. 2 connects gas distribution portion 40 of manifold 32 to swivel 31 of regulator 14. Adaptor 33, FIG. 11 includes end 200 which is pressed into main channel 42, FIG. 4 of manifold 32 and end 202 which screws onto swivel 31, FIG. 2 of regulator 14.

The result, in any configuration, is a torch assembly which is less costly because it has less component parts. The torch assembly of the subject invention is easy to assemble and performs as well as prior art torch assembly. By integrating the nozzles in the unique manifold of the subject invention instead of in the torch tubes, a significant part reduction is achieved leading to a torch which costs less and is easier to manufacture and faster to assemble.

Although specific features of the invention are shown in some drawings and not in others, this is for convenience only as each feature may be combined with any or all of the other features in accordance with the invention. The words "including", "comprising", "having", and "with" as used herein are to be interpreted broadly and comprehensively and are not limited to any physical interconnection. Moreover, any embodiments disclosed in the subject application are not to be taken as the only possible embodiments. Other embodiments will occur to those skilled in the art and are within the following claims.

In addition, any amendment presented during the prosecution of the patent application for this patent is not a disclaimer of any claim element presented in the application as filed: those skilled in the art cannot reasonably be expected to draft a claim that would literally encompass all possible equivalents, many equivalents will be unforeseeable at the time of the amendment and are beyond a fair interpretation of what is to be surrendered (if anything), the rationale underlying the amendment may bear no more than a tangential relation to many equivalents, and/or there are many other reasons the applicant can not be expected to describe certain insubstantial substitutes for any claim element amended.

What is claimed is:

1. A torch comprising:

a regulator securable to a portable gas tank;

a fitting attached to the regulator;

an adapter including a threaded portion connected to the fitting;

a manifold connected to the adapter, the adapter configured to couple the manifold to the fitting; the manifold including:

a gas distributing portion including a main channel configured to receive an end of the adapter and distribute gas from the regulator into two or more gas channels, the depth and width of the main channel configured to radially overlap and intersect the two or more gas channels, the longitudinal axes of the gas channels radially spaced outward from and parallel to a longitudinal axis of the main channel, a nozzle in each gas channel of the manifold gas distribution portion, a flame tube portion corresponding to each gas channel, each corresponding gas channel, corresponding nozzle and corresponding flame tube portion substantially aligned on a longitudinal axis, and a post closely separating the gas distribution portion from the flame tube portion and creating a circumferential air passage in the manifold for the nozzles; and a flame tube extending from each flame tube portion, each flame tube adjacent a said nozzle in said manifold.

2. The torch of claim 1 further including a venturi in each flame tube.

* * * * *